US011328881B2

(12) United States Patent
Ruff

(10) Patent No.: US 11,328,881 B2
(45) Date of Patent: May 10, 2022

(54) KEY MODULE FOR A KEYBOARD AND KEYBOARD

(71) Applicant: Cherry GmbH, Auerbach/Opf (DE)

(72) Inventor: Eduard Ruff, Auerbach (DE)

(73) Assignee: CHERRY GMBH, Auerbach/Opf (DE)

( * ) Notice: Subject to any disclaimer, the term of this patent is extended or adjusted under 35 U.S.C. 154(b) by 0 days.

(21) Appl. No.: 17/272,721

(22) PCT Filed: Sep. 10, 2019

(86) PCT No.: PCT/EP2019/074040
§ 371 (c)(1),
(2) Date: Mar. 2, 2021

(87) PCT Pub. No.: WO2020/053176
PCT Pub. Date: Mar. 19, 2020

(65) Prior Publication Data

US 2021/0210294 A1 Jul. 8, 2021

(30) Foreign Application Priority Data

Sep. 13, 2018 (DE) ..... 10 2018 122 416.8

(51) Int. Cl.
*H01H 13/85* (2006.01)
*H01H 13/83* (2006.01)

(52) U.S. Cl.
CPC ..... *H01H 13/85* (2013.01); *H01H 13/83* (2013.01); *H01H 2215/03* (2013.01); *H01H 2215/034* (2013.01); *H01H 2221/062* (2013.01)

(58) Field of Classification Search
CPC ..... H03K 17/969; H01H 13/70; H01H 13/06; H01H 13/85; H01H 13/83
(Continued)

(56) References Cited

U.S. PATENT DOCUMENTS 9,728,350 B2 * 8/2017 Muller ..... H01H 13/10
9,972,462 B1 * 5/2018 Chen ..... H01H 13/52
(Continued)

OTHER PUBLICATIONS

International Search Report for PCT/EP2019/074040 dated Nov. 22, 2019.

*Primary Examiner* — Edwin A. Leon
*Assistant Examiner* — Iman Malakooti
(74) *Attorney, Agent, or Firm* — James R. Hayne; Stites & Harbison PLLC

(57) ABSTRACT

A key module (110) for a keyboard is presented. The key module (110) comprises a key tappet (220). The key tappet (220) comprises a coupling portion (322) for coupling with a keycap for the key module (110). The key tappet (220) comprises at least one guiding portion (326, 328) for guiding a translational actuation movement of the key tappet (220) between a rest position and an actuated position. The key tappet (220) comprises at least one tappet stop (324) for limiting the actuation movement. The key module (110) also comprises a trigger element (350) for triggering a switch signal of the key module (110) in response to the actuation movement. The trigger element (350) is attachable to the key tappet (220). The key module (110) further comprises a module housing (230), wherein the module housing (230) is integrally formed. The module housing (230) comprises at least one positioning protrusion (334) for positioning the key module (110) and a circuit substrate of the keyboard. The module housing (230) is formed to movably accommodate the key tappet (220), in order to enable the actuation movement of the key tappet (220) relative to the module housing (230). The module housing (230) comprises at least one housing stop (332) for abutment against the at least one tappet stop (324) of the key tappet (220) in the rest position of the key tappet (220). Moreover, the key module (110) comprises elastic means (340). The elastic means (340) is
(Continued)

configured to bias the key tappet (220) into the rest position in an assembled state of the key module (110).

15 Claims, 16 Drawing Sheets

(58) Field of Classification Search
USPC ..... 200/5 A
See application file for complete search history.

(56) References Cited

U.S. PATENT DOCUMENTS

| | | | |
|---|---|---|---|
| 2017/0221653 | A1 | 8/2017 | Liao et al. |
| 2018/0047530 | A1 | 2/2018 | Song et al. |
| 2020/0043680 | A1 | 2/2020 | Ruff |

* cited by examiner

KEY MODULE FOR A KEYBOARD AND KEYBOARD

The present invention relates to a key module for a keyboard and to a keyboard having at least one such key module.

Different types of key switches may be employed in keyboards typically used in connection with computers. In particular, mechanical key modules can be used as a key switches. There are different types of mechanical key modules.

A key module having a lid element, a tappet, a contact element unit, a contact piece and a housing element is described in post-published DE 10 2017 106 406 A1.

Against this background, the present invention provides an improved key module for a keyboard and an improved keyboard according to the main claims. Advantageous embodiments can be seen from the dependent claims and the subsequent description.

According to embodiments of the approach described here, in particular, a mechanical key switch or mechanical key module with a one-piece, integral module housing for receiving a key tappet can be provided. Furthermore, for example, the key module may comprise only one trigger element configured to cause or trigger a switch signal of the key module via an electric circuit on a circuit substrate of the keyboard. Moreover, for example, the key module may be configured to guide the key tappet on a majority of its outer faces in the module housing.

Advantageously, a long-life and robust mechanical key module which can also be realized in a cost-saving manner can be provided. Among other things, this can be achieved by keeping a number of parts of the key module low. Furthermore, tappet guidance can be improved, in particular canting in the course of an actuation movement can be avoided. Also, the key module can be replaced in a simple and uncomplicated manner with respect to the keyboard, particularly also by an end user.

What is presented is a key module for a keyboard, wherein the key module comprises:

a key tappet, wherein the key tappet comprises a coupling portion for coupling to a keycap for the key module, wherein the key tappet comprises at least one guiding portion for guiding a translational movement of the key tappet between a rest position and an actuated position, wherein the key tappet comprises at least one tappet stop for limiting the actuation movement;

a trigger element for triggering a switch signal of the key module in response to the actuation movement, wherein the trigger element is attachable to the key tappet;

a module housing, wherein the module housing is integrally formed, wherein the module housing comprises at least one positioning for positioning the key module on the circuit substrate of the keyboard, wherein the module housing is formed to movably accommodate the key tappet, in order to enable the actuation movement of the key tappet relative to the module housing, wherein the module housing comprises at least one housing stop for abutting against the at least one tappet stop of the key tappet in the rest position of the key tappet; and elastic means, the elastic means being configured to bias the key tappet in the rest position in an assembled state of the key module.

The keyboard may be provided for a computer or the like, for example. The keyboard may comprise at least one key module. The key module may be part of a key or may represent a key. Thus, one key module per key can be provided. The key module may also be referred to as a mechanical push-button or mechanical push-button switch. The key tappet may be integrally formed. The tappet stop and the housing stop may be formed to enable a latch connection or snap connection between the key tappet and the module housing, in order to hold the key tappet in the module housing. In the rest position, the key tappet may be accommodated partially within the module housing. In the actuated position, the key tappet may be accommodated completely within the module housing or completely except for the end portion of the coupling portions. The elastic means may be a compression spring. The elastic means may function as a return spring for the key module. The elastic means may cause a linear force-displacement characteristic in the course of the actuation movement. In other words, the elastic means may comprise a linear spring characteristic. Alternatively, the elastic means may comprise a progressive spring characteristic. The circuit substrate may be a circuit board. The positioning protrusion may be formed as a stud, pin or the like.

According to an embodiment, the module housing may comprise at least one mounting portion for mounting the key module the keyboard with positive locking and additionally or alternatively with non-positive locking. The mounting portion may be and as a flange and additionally or alternatively a snap-fit or the like. The key module may be connected to the circuit substrate while avoiding an adhesive bond between the key module and the circuit substrate of the keyboard. Such an embodiment offers the advantage that a solder-free connection between the key module and the circuit substrate can be realized in a cost-saving manner. Cost may also be saved because a wider selection of materials also with less temperature resistant materials can be used for the key module depending on the ambient temperature of the operational environment. Moreover, a solder-free connection offers simple replacement of key modules by an expert or directly by the end user. This opens up an additional possibility of individual keyboard design, which may be advantageous particularly with gaming users.

Furthermore, the at least one guiding portion of the key tappet may comprise a surface portion of the key tappet. Additionally or alternatively, the at least one guiding portion of the key tappet may comprise a guiding stud formed to plunge into a bulge of the module housing in the course of the actuation movement, wherein the bulge comprises the positioning protrusion. Such an embodiment offers the advantage that a sliding actuation movement of the key tappet relative to the module housing can be enabled with reliable guidance of the key tappet the module housing.

The key tappet may also comprise a surface portion formed as a multi-sided pipe. In a region enclosed by the surface portion, an intermediate bottom may be formed.

From the intermediate bottom, the coupling portion may extend in a first direction partially out of the surface portion. A guiding stud as guiding portion may extend from the surface portion in a second direction opposite to the first direction partially out of the surface portion. Thus, the coupling portion and the guiding stud may be arranged on opposite sides of the intermediate bottom. The surface portion may be a four-sided pipe with chamfered edges. The tappet stop may be formed on the surface portion. A proportion of a dimension of the surface portion with respect to a dimension of the key module along an axis of the actuation movement may be more than 75 percent, more than 80 percent, more than 85 percent or more than 90 percent, for example. Such an embodiment offers the advantage that reliable and stable guidance of the key tappet in the module housing with a lock against rotation and anti-canting protection can be achieved.

Moreover, the key tappet may be formed of translucent material or opaque material. The module housing may be formed of translucent material or opaque material. Such an embodiment offers the advantage that uniform illumination of a keycap coupleable to the key tappet can be achieved from the circuit substrate. Also, illumination of the entire module housing, and thus an environment of the keycap, can be enabled if required.

According to an embodiment, the trigger element may be a contactor for electrically shorting contact pads of the circuit substrate of the keyboard. The trigger element may comprise at least one contact finger for contacting the contact pads while causing friction, which contact finger is elastically deformable in the course of the actuation movement, and an attachment portion for attaching the trigger element to the key tappet. The contactor may be integrally formed. At least the at least one contact finger may be formed from electrically conductive material. In particular, the contactor may be integrally formed as a stamped and bent part from a metal material. The at least one contact finger may exhibit a linear or progressive spring characteristic upon deformation. In the rest position, the at least one contact finger may be spaced from the circuit substrate. In the actuated position, the at least one contact finger may contact the contact pads of the circuit substrate. In particular, the contactor may comprise two contact fingers, wherein the two contact fingers may again be slotted, so that for contact fingers are provided altogether. Such an embodiment offers the advantage that safety of contact can be increased, and thus a switch signal of the key module can be provided in a reliable and reproducible manner. An overall non-linear force-displacement characteristic may also be achieved by way of a combination of a spring force of the elastic element and a spring force of the at least one contact finger in the course of the actuation movement of the key module.

The trigger element may comprise a deflection portion for causing acoustic feedback and additionally or alternatively tactile feedback, wherein the deflection portion is elastically deflectable in the course of the actuation movement. The module housing may comprise an actuation cam formed to deflect the deflection portion of the trigger element in the course of the actuation movement. Such an embodiment offers the advantage that both the triggering of the switch signal and palpable and additionally or alternatively audible feedback of the actuation of the key module can be realized by means of a single component, the contactor.

Furthermore, the deflection portion may be arranged between the contact finger and the attachment portion of the trigger element. The deflection portion may be formed to be U-shaped with a first leg and a second leg. The first leg may be rigidly connected to the trigger element. The second leg may be formed as a clapper movable relative to the first leg and having a control cam for interaction with the actuation cam of the module housing. Moving along a contour of the control cam may effect a non-linear force-displacement characteristic of a deflection of the second leg relative to the first leg in the course of the actuation movement. In the rest position, the control cam of the clapper is spaced from the actuation cam of the housing. Such an embodiment offers the advantage that the control cam and a strike surface, against which the clapper strikes for acoustic feedback on the contactor, are arranged on a single component and particularly on a single subsection of the contactor. Thus, reliability and reproducibility of feedback can be increased.

The trigger element may also comprise an opening. The second leg may engage with the opening. The opening may be formed to enable a first movement of the second leg toward the first leg and away from the first leg for the tactile feedback and optionally additionally a second movement of the second leg transversal with respect to the first movement for the acoustic feedback. In particular, the second movement may take place with a component of movement normal with respect to the first movement. The opening may be formed as a through-hole or a fork or the like. In particular, the opening may be formed as an elongated hole. The opening is configured to effect limitation of a movement of the second leg. The first movement and the second movement may be caused by interaction of the control cam and the actuation cam. Such an embodiment offers the advantage that the desired type of feedback or the desired types of feedback can be provided in a reliable, defined and reproducible manner.

According to an embodiment, the module housing may comprise an abutment surface. The trigger element may be arranged so as to abut on the abutment surface in the rest position of the key tappet. The abutment surface may be formed at least so that the trigger element and thus the key tappet can be prevented from sliding back to a position prior to first-time actuation. Such an embodiment offers the advantage that settling vibrations of the trigger element after returning from the actuation position to the rest position can be dampened.

What is also presented is a keyboard, wherein the keyboard comprises:

at least one exemplar of an embodiment of the previously presented key module; and a circuit substrate, wherein the at least one key module is arranged on the circuit substrate.

Thus, at least one previously presented key module may be employed or used in conjunction with the keyboard. The at least one key module may be attached directly to the circuit substrate.

According to an embodiment, the circuit substrate may comprise at least one hole into which the at least one positioning protrusion of the module housing of the at least one key module is inserted. In particular, positive locking between the key module and the circuit substrate may be achieved here. Such an embodiment offers the advantage that simple and accurate positioning of the key module relative to the circuit substrate can be achieved.

In particular, the at least one key module and the circuit substrate may be connected to each other exclusively by positive locking and additionally or alternatively by non-positive locking. The positive locking and additionally or alternatively non-positive locking between key module and circuit substrate may be affected by means of the at least one positioning protrusion and at least one mounting portion of the module housing. Such an embodiment offers the advantage that a reliable, inexpensive connection simply detachable for replacement can be realized.

At least one light-emitting diode for illuminating the at least one key module and additionally or alternatively further electronic devices may also be arranged on or in the circuit substrate. Contact pads, which may be electrically connected to each other upon actuation of the at least one key module, may also be arranged on or in the circuit substrate. The at least one light-emitting diode and additionally or alternatively the further electronic devices may be attached by means of a surface-mounting process or a soldering process. The further electronic devices may be resistors, diodes or the like. Such an embodiment offers the advantage that the key module can be kept free from electronics. Furthermore, simple illumination of the key module or the key can be achieved.

Furthermore, the keyboard may comprise a fixing element for fixing the at least one key module to the circuit substrate. The fixing element may be formed as a key frame between the circuit substrate and a keyboard top or as a keyboard top. The fixing element may be configured to engage in positive and additionally or alternatively non-positive locking with at least one mounting portion of the module housing of the key module. Such an embodiment offers the advantage that a keyboard can be realized inexpensively, wherein long-life and robust key modules can be replaced easily and allow for precise actuation.

The invention shall be explained in greater detail by way of example on the basis of the attached drawings, in which.

In the subsequent description of preferred embodiments of the present invention, the same or similar reference numerals shall be used for similarly acting elements illustrated in the various figures, wherein repeated description of these elements shall be omitted.

Figure 1:
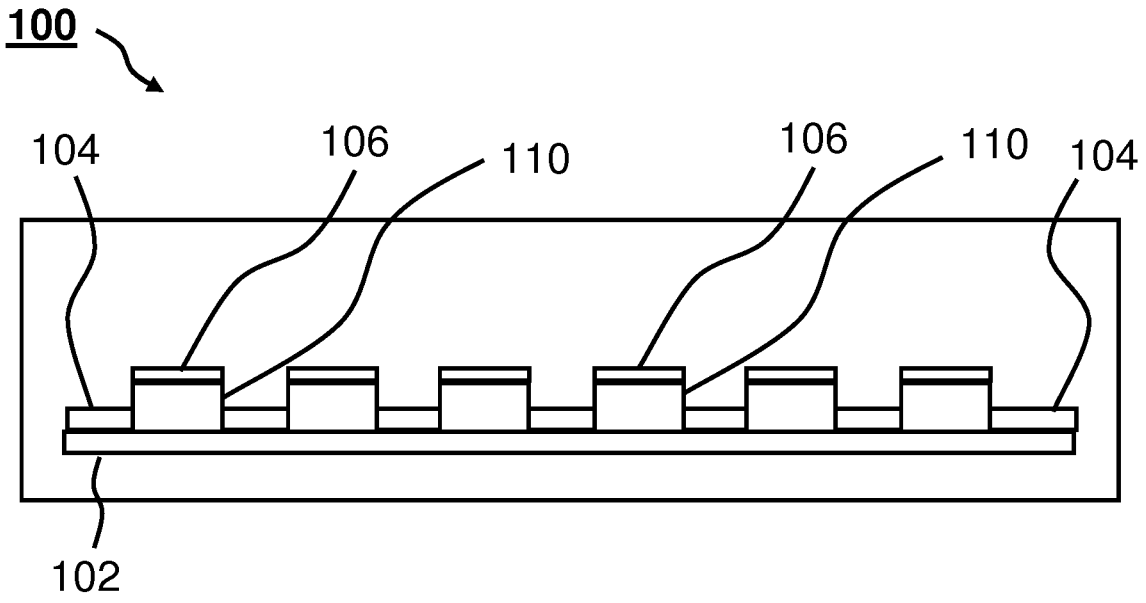
FIG. 1 shows a schematic illustration of a keyboard according to an embodiment of the present invention.

FIG. 1 shows a schematic illustration of a keyboard 100 with key modules 110 according to an embodiment. For example, the keyboard 100 is part of a notebook computer, laptop computer or the like. Alternatively, the keyboard 100 is designed as a peripheral device for a computer, in particular.

The keyboard 100 comprises a circuit substrate 102. The circuit substrate 102 is a circuit board, conductor board or the like, for example. According to the embodiment illustrated in FIG. 1, the keyboard 100 comprises a plurality of key modules 110. The key modules 110 are arranged on the circuit substrate 102.

According to the embodiment illustrated in FIG. 1, the keyboard 100 also comprises a fixing element 104 for fixing the key modules 110 to the circuit substrate 102. More specifically, the fixing element 104 is formed to establish positive locking and additionally or alternatively non-positive locking with the key module. Herein, the fixing element 104 is only exemplarily formed as a key frame. Alternatively, the fixing element 104 may be formed as a keyboard top.

Furthermore, according to the embodiment shown and described in FIG. 1, a keycap 106 is attached to each key module 110. Each keycap 106 is coupled to a key module 110 of its own. Each unit of key module 110 keycap 106 represents a key of the keyboard 100. Alternatively, each key module 110 represents a key of the keyboard 100. Particularly the key modules 110 shall be explained in greater detail with reference to subsequent figures.

The keycap 106 represents a part of a key visible and touchable for a user of the keyboard 100. Actuation of a key module 110 is effected by pressing onto the keycap 106. Each key module 110 is configured to react with a force-displacement characteristic of resistance or reset force to an actuation force. Furthermore, each key module 110 is configured to establish an electrical connection in response to actuation with a pre-definable actuation path, thereby executing a switching procedure.

Figure 2:
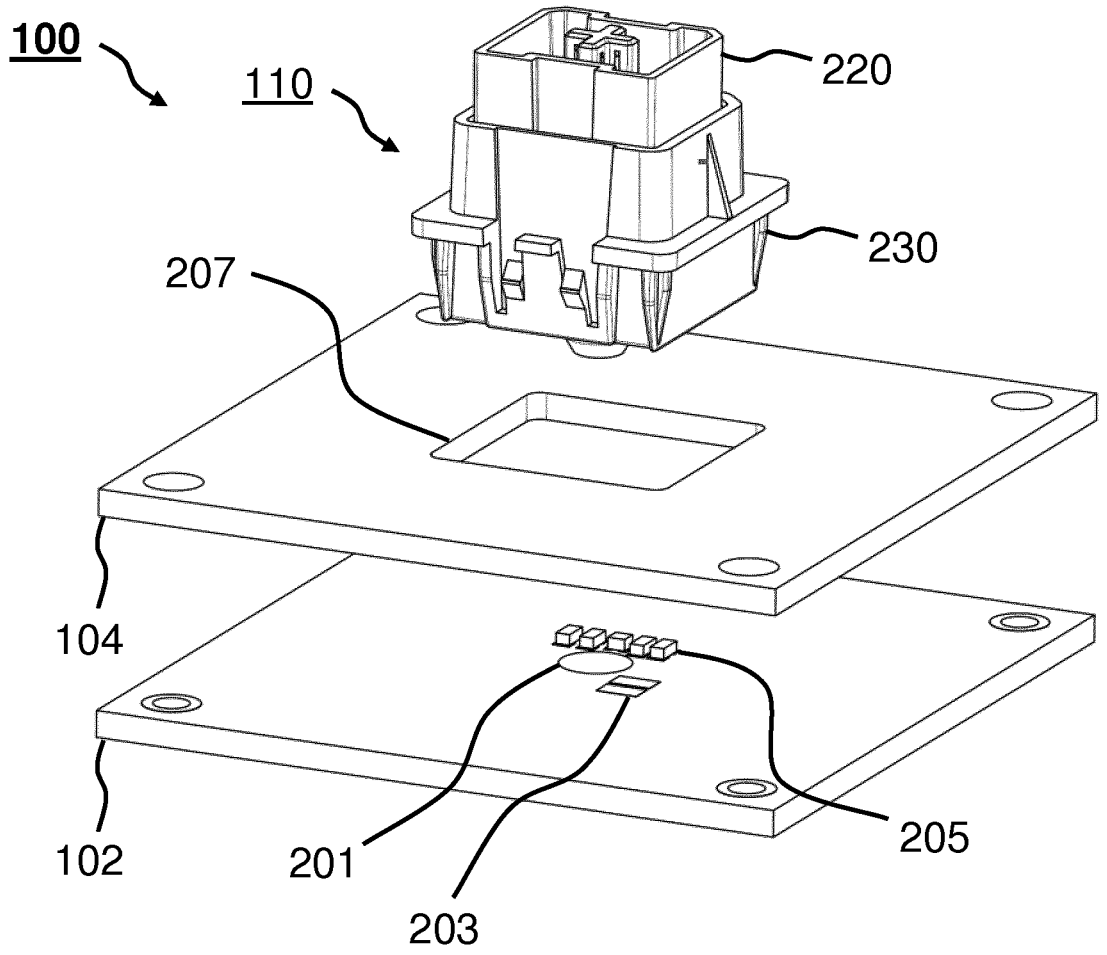
FIG. 2 shows a partially exploded view of a subsection of a keyboard according to an embodiment of the present invention.

FIG. 2 shows a partially exploded view of a subsection of a keyboard 100 according to an embodiment of the present invention. The keyboard 100 here corresponds to or is similar to the keyboard from FIG. 1. The circuit substrate 102, the fixing element 104 formed as the keyframe, and the key module 110 are shown here.

A hole 201 is formed in the circuit substrate 102. A positioning protrusion of the key module 110 can be introduced or inserted into the hole 201 of the circuit substrate 102. Furthermore, two electric contact pads 203 or switch pads, which can be shorted by the key module 110 in an actuation movement of the key module 110, are arranged on or in the circuit substrate 102. Moreover, according to the embodiment illustrated here, a plurality of electronic devices 205 are arranged on or in the circuit substrate 102. The electronic devices 205 are a light-emitting diode and, for example, electric resistors and/or the like. The contact pads 203 and the devices 205 are arranged in the neighborhood of the hole 201.

A holding opening 207 for being the key module 110 is formed the fixing element 104. The key module 110 can be inserted and latched in the holding opening 207. When the circuit substrate 102 and the fixing element 104 are stacked on each other, the hole 201, the contact pads 203 and the devices 205 of the circuit substrate 102 are exposed by the holding opening 207 of the fixing element 104.

A key tappet 220 and a module housing 230 are shown of the key module 110 in the illustration of FIG. 2. In an actuation movement, the key tappet 220 is movable relative to the module housing 230. The key tappet 220 is shown to be accommodated in the module housing 230 in the illustration of FIG. 2. Specifically, the key tappet 220 is shown in a rest position relative to the module housing 230 here, wherein the key tappet 220 is partially accommodated in the module housing 230 in the rest position. The key module 110 shall be explained in greater detail with reference to subsequent figures.

In other words, FIG. 2 shows an exploded view of a subsection of a keyboard 100. E.g. at least one light-emitting diode for switch illumination, resistors, diodes or sensors, for example, may be mounted on the circuit substrate 102 as the devices 205 by means of a surface-mounting process or conventional soldering process. The key module 110 is positioned on the circuit substrate 102 by means of the whole 201 and a positioning protrusion formed as a stud of the key module 110. Fixing of the key module 110 takes place by means of a snap-action connection in the holding opening 207 of the fixing element 104. According to another embodiment, a top part of the keyboard 100 may function as the fixing frame or fixing element 104. Simple assembly and disassembly for replacing the key module 110 are possible.

Figure 3:
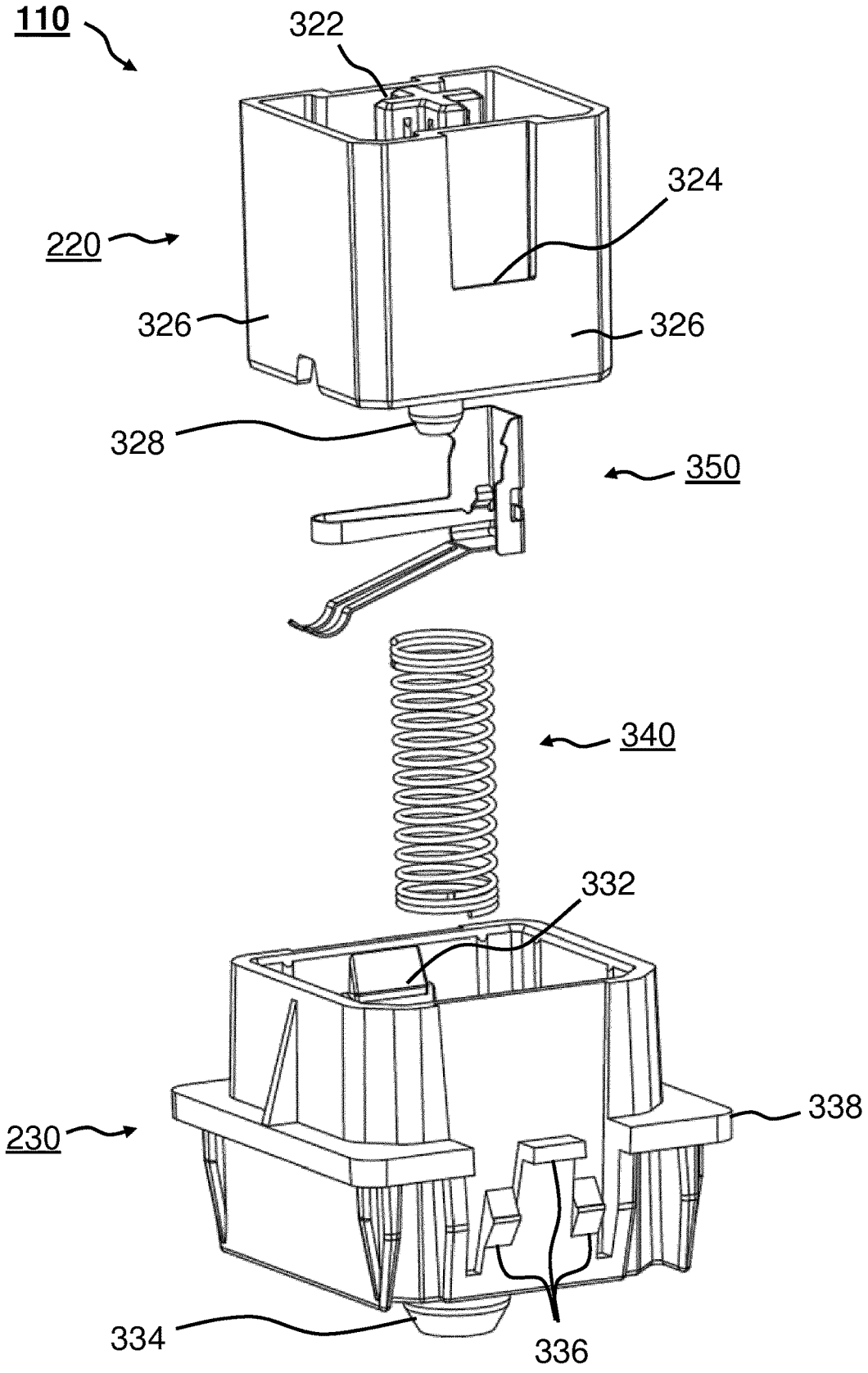
FIG. 3 shows an exploded view of the key module from FIG. 2

FIG. 3 shows an exploded view of the key module 110 from FIG. 2. The key module 110 comprises the key tappet 220, the module housing 230, elastic means 340 and a trigger element 350.

When the key module 110 is being actuated, the key tappet 220 is translationally movable relative to the module housing 230 between a rest position and an actuated position. This is referred to as the actuation movement of the key tappet 220. According to the embodiment illustrated in FIG. 3, the key tappet 220 is integrally formed. According to an embodiment, the key tappet 220 is formed of a translucent material. Thus, uniform illumination of a keycap can be realized. According to another embodiment, the key tappet 220 is formed of an opaque material.

The key tappet 220 comprises a coupling portion 322. The coupling portion 322 is formed to be mechanically coupleable to a keycap for the key module 110. The coupling portion 322 extends along an axis of movement of the actuation movement. According to the embodiment illustrated here, the coupling portion 322 has a cross-shaped cross-sectional profile.

The key tappet 220 further comprises at least tappet stop 324 for limiting the actuation. Even though it is only implicitly shown in FIG. 3 owing to the illustration, the key tappet 220 comprises two tappet stops 324. Each of the tappet stops 324 is formed as a step, a shoulder or a ledge.

The key tappet 220 further comprises at least one guiding portion for guiding the actuation. According to the embodiment illustrated here, the key tappet 220 comprises a surface portion 326 of the key tappet 220 and a guiding stud 328 as guiding portions. The surface portion 326 is formed as a multi-sided pipe, according to an embodiment. More specifically, according to the embodiment illustrated here, the surface portion 326 is formed as a four-sided pipe with chamfered edges as a lock against rotation. In other words, the surface portion 326 is formed by outside walls of the key tappet 220 extending along the axis of the actuation movement. The guiding stud 328 also extends along the axis of the actuation movement.

The trigger element 350 of the key module 110 is configured to trigger a switch signal of the key module 110 in response to the actuation movement. More specifically, the trigger 350 is formed to trigger the switch signal by acting on the circuit substrate of the keyboard. The trigger element 350 is attachable to the key tappet 220. In particular, the trigger element 350 is attachable to an area of the key tappet 220 closed by the surface portion 326. According to the embodiment illustrated here, the trigger element 350 is a contactor 350. The contactor 350 shall be explained in greater detail with reference to subsequent figures.

The module housing 230 is integrally formed. The module housing 230 is formed to movably accommodate the key tappet 220, in order to enable the actuation movement of the key tappet 220 relative to the module housing 230. A body of the module housing 230 here is trough-shaped. According to an embodiment, the module housing 230 is formed of translucent material. Thus, ambient illumination for the keycap can be realized. According to another embodiment, the module housing 230 is formed of a brake material. In this way, illumination of the key module 110 can be restricted to the keycap.

The module housing 230 comprises at least one housing stop 332 for limitation of movement for the key tappet 220. Even though it is only implicitly illustrated in FIG. 3, the module housing 230 comprises two housing stops 332. Each of the housing stops 332 is formed to abut against a respective one of the tappet stops 324 of the key tappet 220 in the rest position of the key tappet 220. Each of the housing stops 332 is formed as a step, a shoulder or a ledge, complementary to the respective one of the tappet stops 324. The key tappet 220 can be latched and held in the module housing 230 by way of interaction of the tappet stops 324 and the housing stops 332.

Furthermore, the module housing 230 comprises at least one positioning protrusion 334. The positioning protrusion 334 is formed to position the module housing 230 and thus the assembled key module 110 on the circuit substrate of the keyboard. The positioning protrusion 334 is formed as a stud or pin. The positioning protrusion 334 extends along the axis of the actuation movement. According to the embodiment illustrated here, the positioning protrusion 334 is formed by a bulge of the module housing 230. The guiding stud 328 of the keycap 220 is formed to plunge into this bulge the course of the actuation movement.

Moreover, according to the embodiment illustrated here, the module housing 230 comprises a mounting portion 336 for mounting the key module 110 in the keyboard with positive locking and/or non-positive locking. The mounting portion 336 comprises latching protrusions or lugs for latching the fixing element, in particular in the holding opening of the fixing element of the keyboard. A flange 338 formed around the module housing 230 functions as a further mounting portion or as a stop with respect to the positive and/or non-positive locking.

According to the embodiment illustrated here, the elastic means 340 of the key module 110 is a compression spring. The elastic means 340 is configured to bias the key tappet 220 in the rest position in an assembled state of the key module 110. The elastic means 340 can be put over the guiding stud 328 of the key tappet 220. Thus, the elastic means 340 is arrangeable between the key tappet 220 and the module housing 230. The elastic means 340 may also be referred to as a return spring.

According to an embodiment, the key tappet 220 is transparent or translucent, for example, in order to uniformly illuminate symbols on the keycap. Furthermore, the module housing 230 is translucent, for example, in order to illuminate gaps between keys, or is opaque in order to leave gaps unilluminated. According to an embodiment, the actuation movement has a linear-progressive force-displacement characteristic. The elastic means 340 has a linear force-displacement characteristic. From a switching point of the key module 110 onward, the contactor 350 is increasingly biased and changes the force-displacement characteristic of the key module 110.

Figure 4:
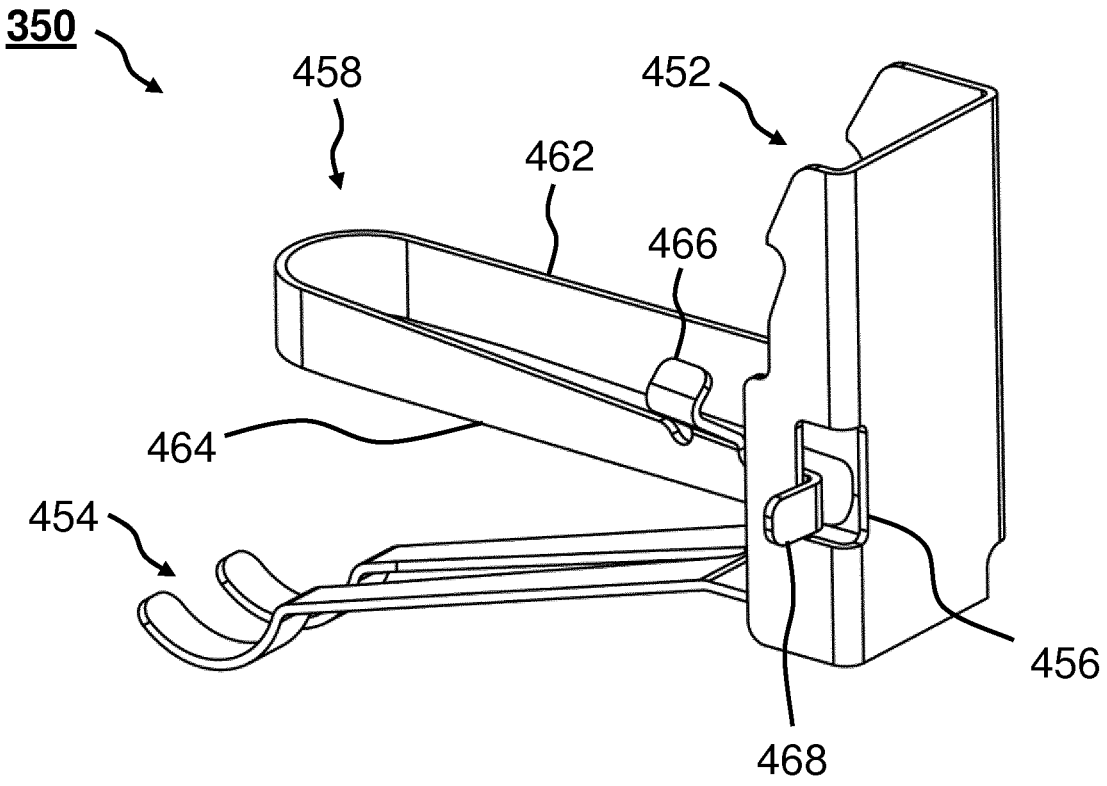
FIG. 4 shows the contactor from FIG. 3.

FIG. 4 shows the contactor 350 from FIG. 3. The contactor 350 is integrally formed. For example, the contactor 350 is formed of a metal material by punching and bending. The contactor 350 is configured to electrically short the contact pads of the circuit substrate of the keyboard.

The contactor 350 comprises an attachment portion 452, by means of which the contactor 350 is attachable to the key tappet of the key module. More specifically, the attachment portion 452 of the contactor 350 can be press fit into the key tappet. The contactor 350 also comprises at least one contact finger 454. According to the embodiment illustrated here, the contactor 350 comprises two contact fingers 454, for example. The contact fingers 454 are elastically deformable in the course of the actuation movement. The contact fingers 454 are configured to contact the contact pads of the circuit substrate while generating friction in the course of the actuation movement toward the actuated position. According to the embodiment illustrated here, end portions of the contact fingers 454 are curved or bent. According to an embodiment, the contactor 350 comprises two double fingers 454 or a total of four contact fingers 454. In this way, redundant contact can be achieved. Thus, reliability and safety of contact can be increased further.

According to the embodiment illustrated here, the contactor 350 further comprises a deflection portion 458. The deflection portion 458 is elastically deflectable in the course of the actuation movement. The deflection portion 458 is configured to produce acoustic feedback and/or tactile feedback in response to its deflection. The deflection portion 458 is arranged between the attachment portion 452 and the contact fingers 454. More specifically, the deflection portion 458 is U-shaped. The deflection portion 458 comprises a first leg 462 and a second leg 464. The deflecting portion 558 is rigidly or fixedly connected to the contactor 350 on the first leg 462. The second leg 464 is elastically movable relative to the first leg 462 in the course of the actuation movement. The second leg 464 is formed as a clapper or functions as a clapper of the contactor 350. A control cam 466 is arranged in a free end portion of the second leg 464. In the course of the actuation movement, the control cam 466 comes to interact with an actuation cam of the module housing, in order to effect the deflection of the deflection portion 458. Furthermore, a strike portion 468 is arranged in the free end portion of the second leg 464. The free end portion of the second leg 464 engages in opening 456 of the contactor 350. Beyond the passage through the opening 456, the strike portion 468 is bent or curved. The opening 456 is formed in the region of the deflection portion 458. The opening 456 is formed to enable an elastic first movement of the second leg 464 toward the first leg 462 and away from the first leg 462 for the tactile feedback. According to the embodiment illustrated here, the opening 456 is further formed to enable an elastic second movement of the second leg 464 transversal with respect to the first movement for the acoustic feedback. Here, a sudden strike of the strike portion 468 occurs against a rim of the opening 456. According to the embodiment illustrated here, the opening 456 is an elongated hole. According to another embodiment, the opening 456 may also be a fork or the like.

The deflection portion 458 may also be referred to as a click mechanism with a U-shaped click spring. Stiffness or elasticity of the deflection portion 458 for the first movement and the second movement is adjustable when forming the deflection portion 458. A purely tactile feedback is realized by shortening the opening 456 correspondingly so that the clapper or strike portion 468 of the second leg 464 can only be deflected for the first movement. Moving along a contour of the control cam 466 in the course of the actuation movement causes a non-linear force-displacement characteristic and does not cause any audible sound. According to an embodiment, the contactor 350 can be formed without the deflection portion 458. This makes the contactor 350 even more simple and inexpensive. In summary, the contactor 350 can be realized in three variants depending on the desired switching characteristic: linear-progressive tactile tactile and acoustic or clicking. A linear-progressive characteristic in the key module is brought about as follows: the elastic means has a linear force-displacement characteristic. From a switching point of the key module onward, the contact fingers 454 of the contactor 350 are increasingly biased and change the force-displacement characteristic of the key module. Upon switch actuation or for triggering the switch signal, the contact pads of the circuit substrate are shorted by means of the contact fingers 454, with the respective switch state of the key being generated.

Figure 5:
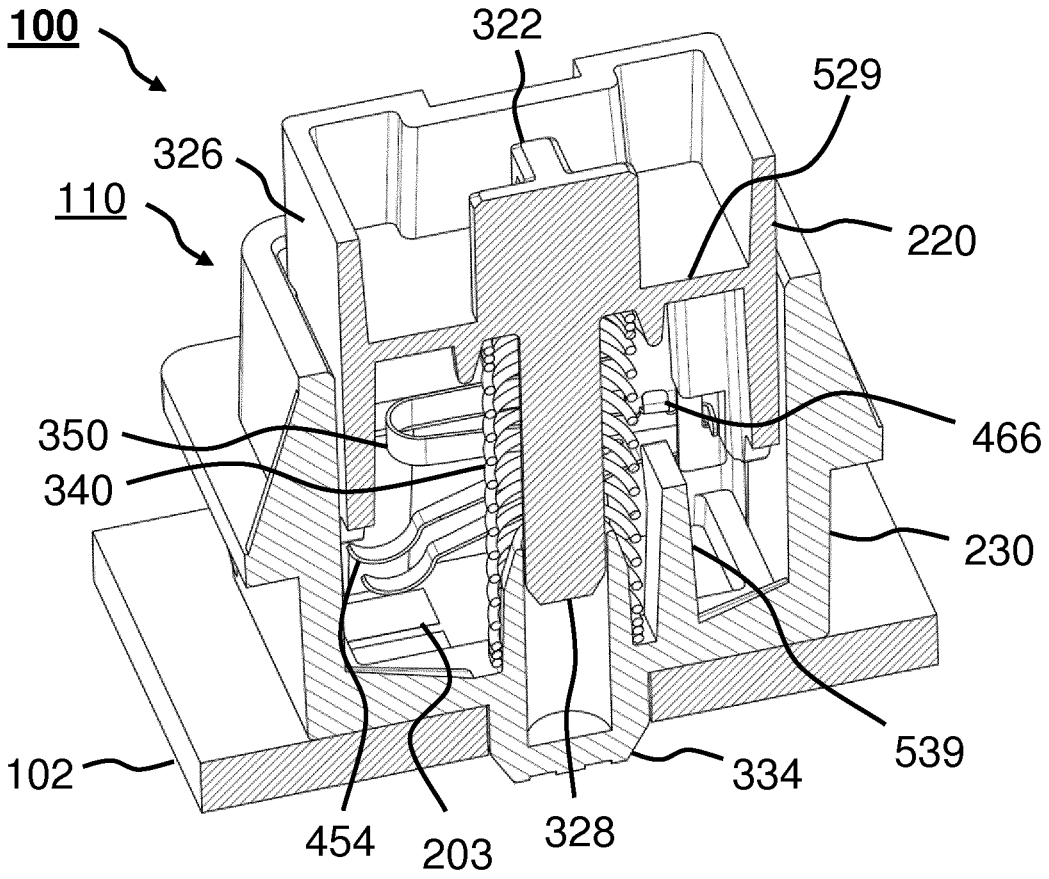
FIG. 5 shows a partially sectional view of a subsection of a keyboard according to an embodiment of the present invention.

FIG. 5 shows a partially sectional view of a subsection of the keyboard 100 according to an embodiment of the present invention. The subsection of the keyboard 100 corresponds to the subsection illustrated in FIG. 2, wherein the key module 110 is arranged on the circuit substrate 102 and the fixing element is omitted. Here, the circuit substrate 102 with the contact pads 203, which only one is designated with a reference numeral for lack of space, and the key module 110 are shown of the keyboard 100. The key tappet 220 with the coupling portion 322, the surface portion 326, the guiding stud 328 and an intermediate bottom 529, the module housing 230 with the positioning protrusion 334 and an actuation cam 539, the elastic means 340 and the trigger element formed as contactor 350 with the contact fingers 454, of which only one is designated with a reference numeral for lack of space, and the control cam 466 are shown of the key module 110 in the illustration of FIG. 5.

The key module 110 is shown in the rest position. Herein, a subsection of the surface portion 326 protrudes from the module housing 230. The guiding stud 328 of the key tappet 220 plunges into a bulge of the module housing 230, which comprises or forms the positioning protrusion 334. Furthermore, the actuation cam 539 of the module housing 230 is shown. The actuation cam 539 is formed to interact with the control cam 566 of the contactor 350, in order to deflect the deflection portion of the contactor 350 in the course of the actuation and or move the second leg relative to the first leg. What is also shown is the intermediate bottom 529, which is formed in the region enclosed by the surface portion 326 of the key tappet 220. The coupling portion 322 of the key tappet 220 extends from the intermediate bottom 529 in a first direction. The guiding stud 328 extends from the intermediate bottom 529 in a second direction opposite to the first direction.

Figure 6:
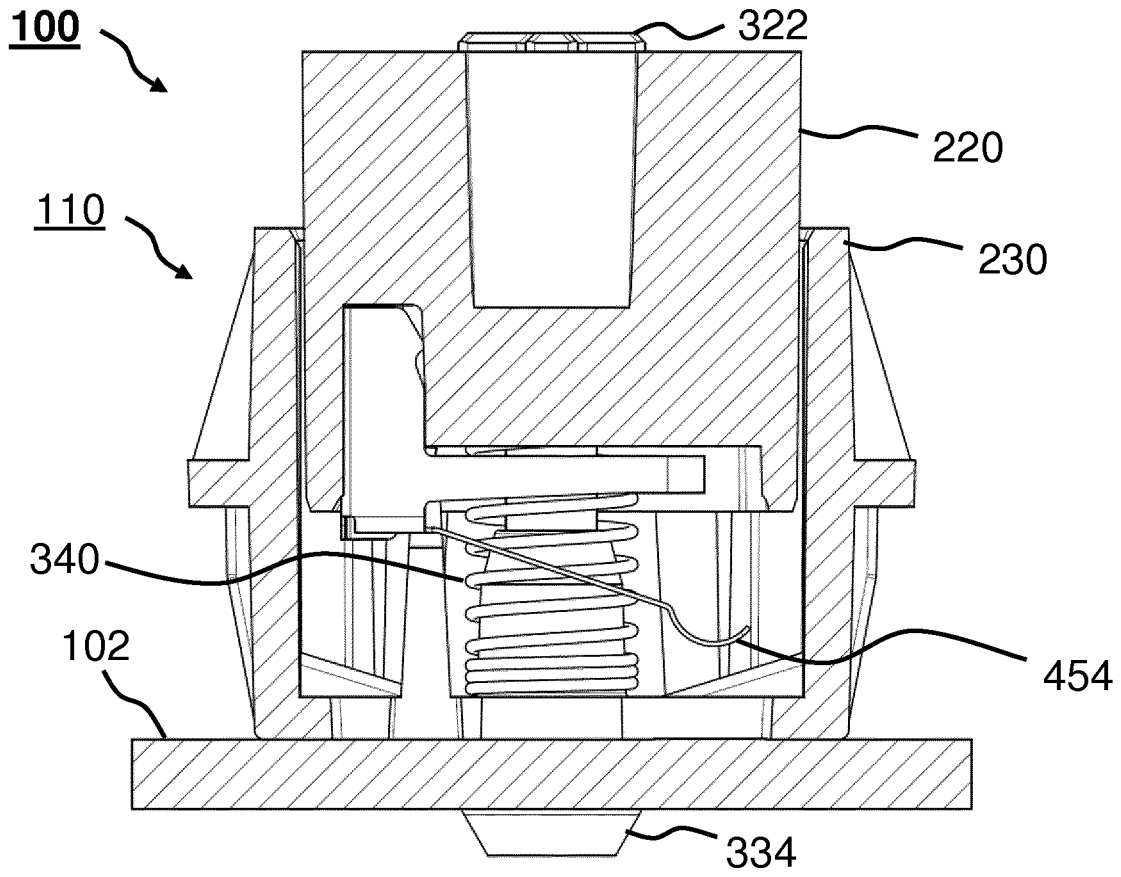
FIG. 6 shows a partially sectional view of a subsection of a keyboard according to an embodiment of the present invention with a key module in a rest position.

FIG. 6 shows a partially sectional view of a subsection of a keyboard 100 according to an embodiment of the present invention with a key module 110 in a rest position. The subsection of the keyboard 100 corresponds to the subsection illustrated in FIG. 2, wherein the key module 110 is arranged on the circuit substrate 102 and the fixing element is omitted. Thus, the illustration in FIG. 6 is similar to the illustration from FIG. 5, except that a sectional plane is changed. In FIG. 6, the circuit substrate 102 and the key module 110 are shown of the keyboard 100, wherein the key tappet 220 with the coupling portion 322, the module housing 230 with the positioning protrusion 334, the elastic means 340 and a contact finger 454 of the contactor are shown of the key module 110. In the rest position of the key module 110, the at least one contact finger 454 of the contactor is spaced from the circuit substrate 102. The rest position represents a beginning and an end of the actuation movement. It can also be seen that only an end portion of the coupling portion 322 protrudes from the surface portion of the key tappet 220.

Figure 7:
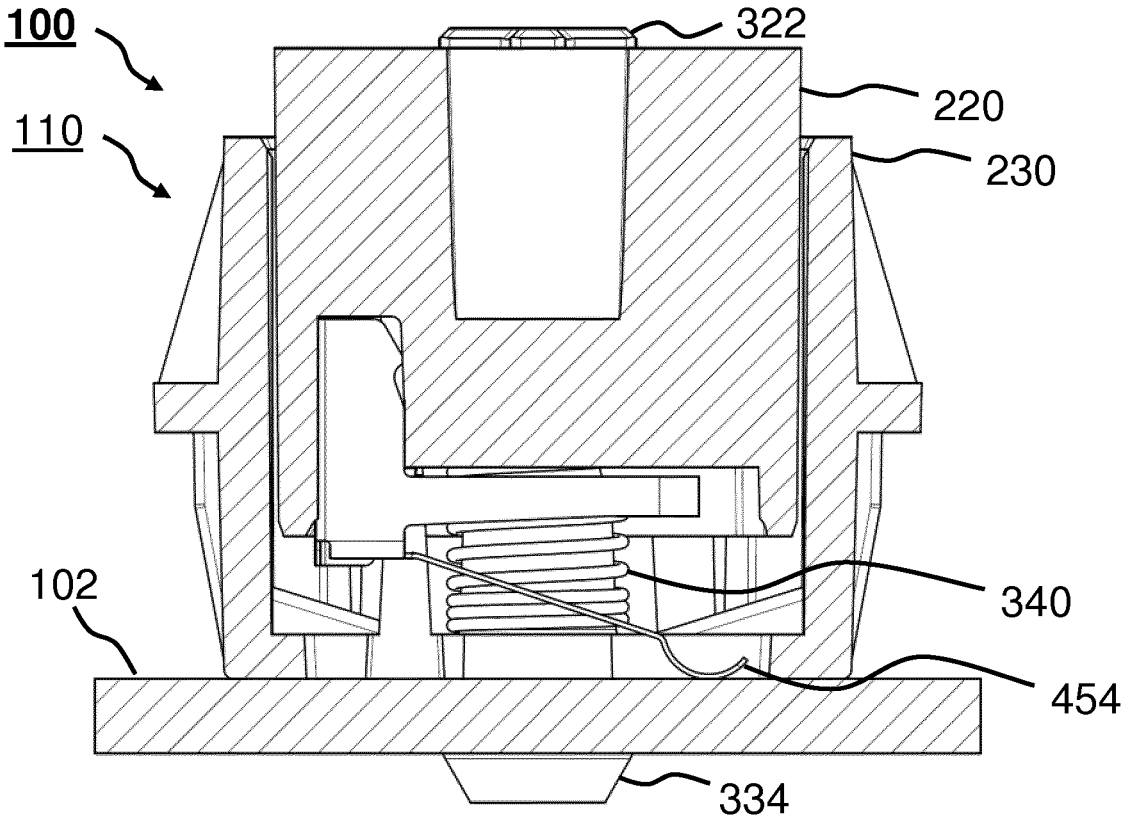
FIG. 7 shows a partially sectional view of a subsection of a keyboard according to an embodiment of the present invention with a key module in the course of actuation movement.

FIG. 7 shows a partially sectional view of a subsection of a keyboard 100 according to an embodiment of the present invention with a key module 110 in the course of an actuation movement. The illustration in FIG. 7 corresponds to the illustration from FIG. 6, except that the key module 110 is shown at a switching point or in a switching position during the actuation movement. Compared with the rest position, the key tappet 220 here is moved further into the module housing 230, wherein the contact finger 454 of the contactor contacts the circuit substrate 102 or the contact pads on the circuit substrate 102.

Figure 8:
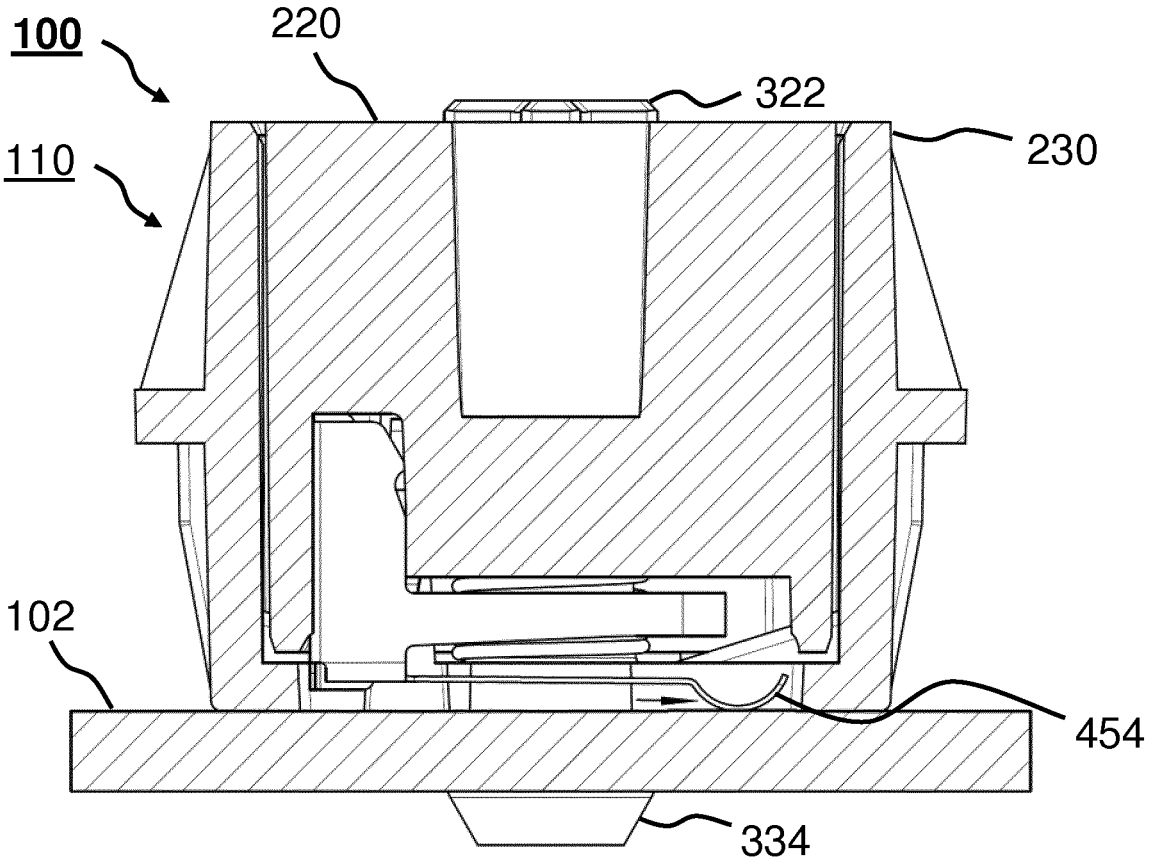
FIG. 8 shows a partially sectional view of a subsection of a keyboard according to an embodiment of the present invention in the actuated position.

FIG. 8 shows a partially sectional view of a subsection of a keyboard 100 according to an embodiment of the present invention with a key module 110 in an actuated position. The illustration in FIG. 8 corresponds to the illustration from FIG. 6 or FIG. 7, except that the key module 110 is shown in the actuated position. The actuated position represents a reversal point of the actuation movement. The contact finger 454 of the contactor continues to contact the circuit substrate 102 or the contact pads on the circuit substrate 102. Between the switching position of the key module 110 illustrated in FIG. 7 and the actuated position of the key module 110 illustrated in FIG. 8 frictional contact or contact with a frictional component between the contact finger 454 and the contact pads of the circuit substrate 102 takes place.

In other words, FIGS. 6 to 8 show at different phases of a switching process or the actuation movement. It is an advantage of the switching mechanism or contactor that in the course of the actuation movement the contact fingers 454 increasingly build up a contact force and additionally perform a rubbing movement along a plane of the circuit substrate 102, thereby achieving a self-cleaning effect. The contact zones or contact pads on the circuit substrate 102 may additionally be protected by way of a contact grease, which prevents oxidation and minimizes wear of contact parts.

Figure 9:
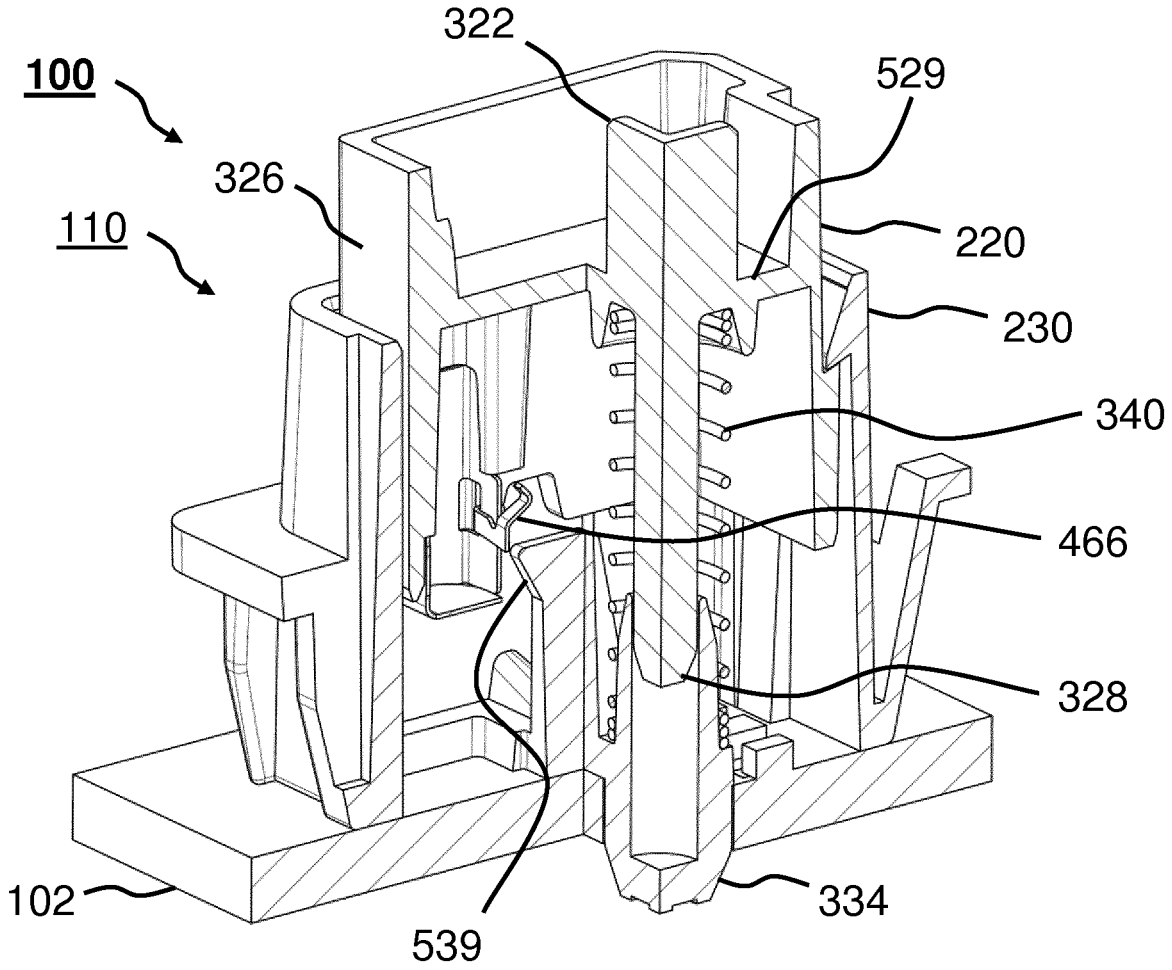
FIG. 9 shows a partially sectional view of a subsection of a keyboard according to an embodiment of the present invention with a key module in a rest position.

FIG. 9 shows a partially sectional view of a subsection of a keyboard 100 according to an embodiment of the present invention with a key module 110 in a rest position. The subsection of the keyboard 100 corresponds to the subsection illustrated in FIG. 2, wherein the key module 110 is arranged on the circuit substrate 102 and the fixing element is omitted. Thus, the illustration in FIG. 9 is similar to the illustration from FIG. 5 or FIG. 6, except that a sectional plane is changed. In FIG. 9, the circuit substrate 102 and the key module 110 are shown of the keyboard 100, wherein the key tappet 220 with the coupling portion 322, the surface portion 326, the guiding stud 328 and the intermediate bottom 529, the module housing 230 with the positioning protrusion 334 and the actuation cam 539, the elastic means 340 and the control cam 466 of the contactor are shown of the key module 110. If the rest position, the control cam 466 of the clapper or second leg of the contactor is not in contact with the actuation cam 539 of the module housing 230 or is spaced therefrom. The actuation cam 539 extends from a switch bottom of the module housing 230 along an axis of the actuation movement in the direction of the key tappet 220 and has a defined contour.

Figure 10:
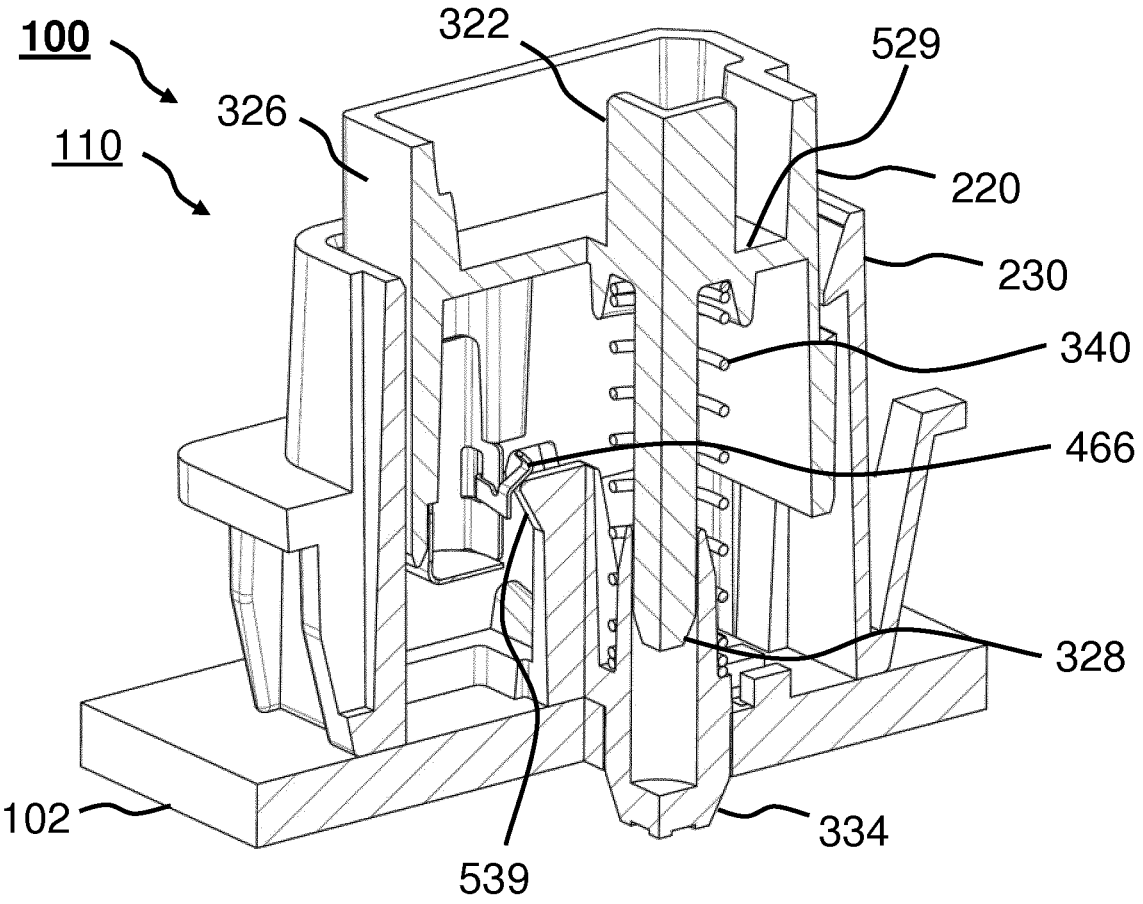
FIG. 10 shows a partially sectional view of a subsection of a keyboard according to an embodiment of the present invention with a key module in a pre-actuated state.

FIG. 10 shows a partially sectional view of a subsection of a keyboard 100 according to an embodiment of the present invention with a key module 110 in a pre-actuated state. The illustration in FIG. 10 corresponds to the illustration from FIG. 9, except that the key module 110 is shown in the course of the actuation movement in the pre-actuated state after leaving the rest position. Here, the control cam 466 of the contactor contacts the actuation cam 539 of the module housing 230 or has come into mechanical contact therewith.

Figure 11:
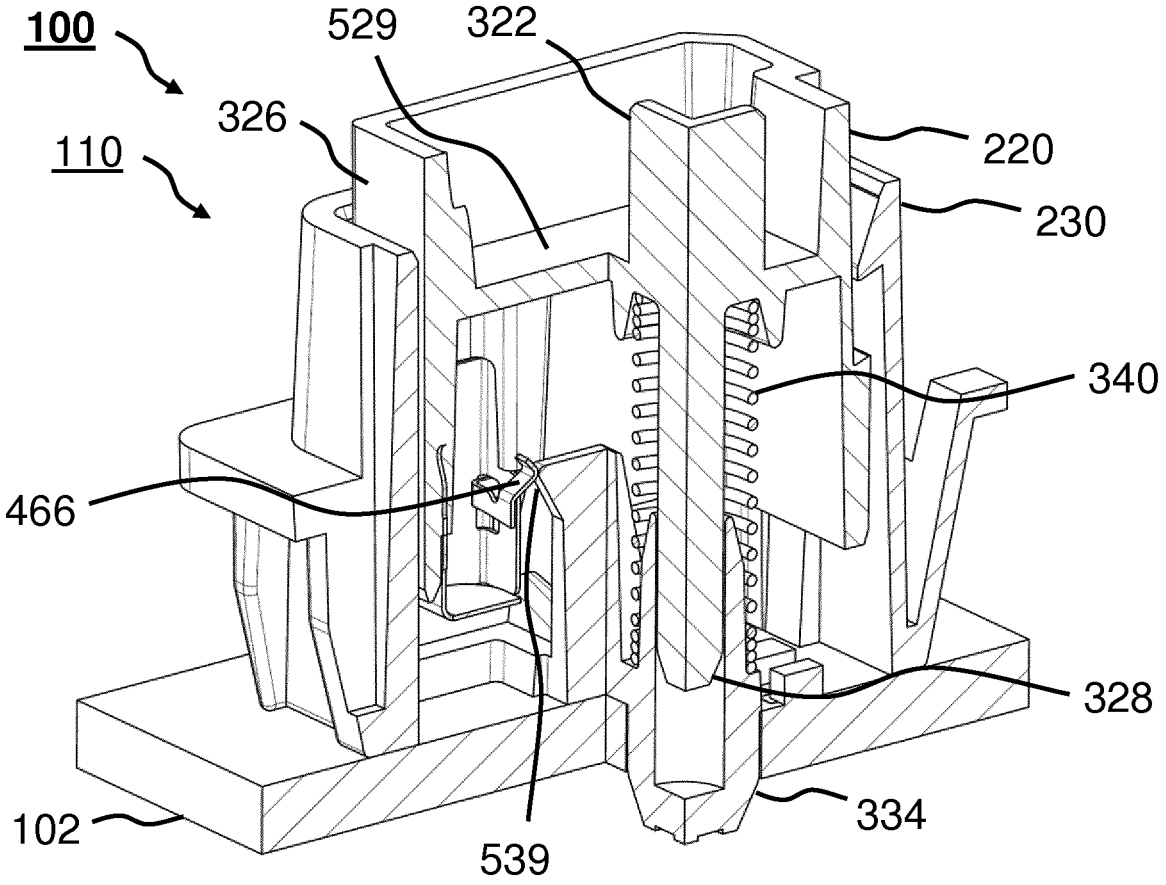
FIG. 11 shows a partially sectional view of a subsection of a keyboard according to an embodiment of the present invention with a key module at a click point.

FIG. 11 shows a partially sectional view of a subsection of a keyboard 100 according to an embodiment of the present invention with a key module 110 at a click point. The illustration in in FIG. 11 corresponds to the illustration from FIG. 10, except that the key module 110 is shown in a further course of the actuation movement after the pre-actuated state at the click point. Upon further actuation, a tip of the actuation cam 539 slides over a contour or slope of the control cam 466. Owing to relative angles and friction between the two parts, the clapper or the second leg of the contactor is elastically deflected in the direction away from the circuit substrate 102 until striking in the opening of the contactor. At the same time, elastic deflection of the clapper or second leg towards the first leg occurs until a tip of the actuation cam 539 is over a tip of the control cam 466 this estate is referred to as the click point. The click point can be influenced exactly or defined and/or changed accurately by way of a position of the actuation cam 539.

Figure 12:
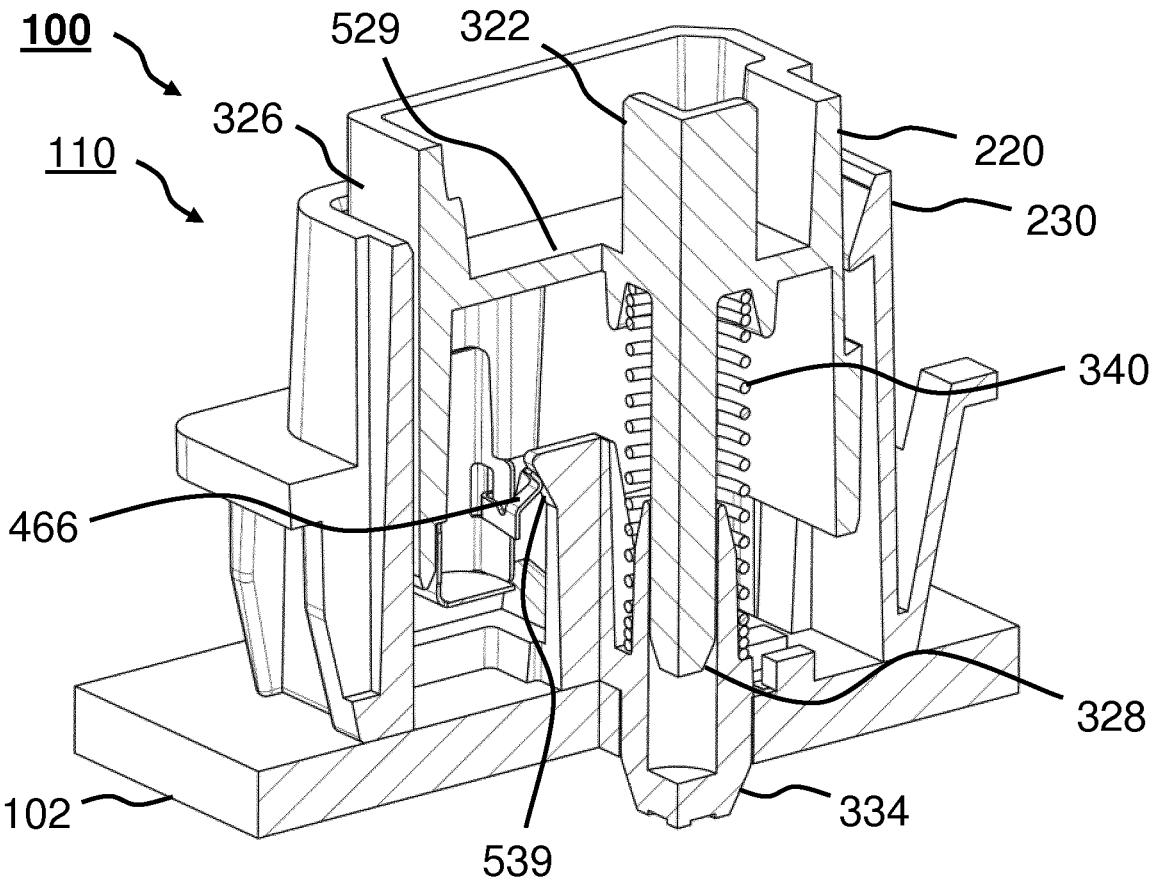
FIG. 12 shows a partially sectional view of a subsection of a keyboard according to an embodiment of the present invention with a key module in a feedback position.

FIG. 12 shows a partially sectional view of a subsection of a keyboard 100 according to an embodiment of the present invention with a key module 110 in a feedback position. The illustration in FIG. 12 corresponds to the illustration from FIG. 11, except that the key module 110 is shown in a further course of the actuation movement after the click point in the feedback position. After the click point, the clapper or second leg of the contactor is suddenly released and moves within the opening of the contactor to a stop on a lower edge of the opening facing the circuit substrate 102. Thereby, a sound or acoustic feedback, which is referred to as a clicking sound, is produced.

Sound volume depends on stored energy in the defection portion of the contactor, which is referred to as click mechanism or click spring. An amount of energy can be adjusted via a length of the opening formed as an elongated hole or via a cross-section and/or a length of the defection portion.

It is possible to synchronize an electric switch point of the key module 110 with the click point, or to arbitrarily adjust the same before or after the electric switch point. Contours of the control cam 466 and of the actuation cam 539 also influence a force-displacement characteristic of the key module 110 in the actuation movement. According to the embodiment illustrated here, a pressure point synchronized with the acoustic click point forms the tactile feedback. Precision and thus reproducibility of the acoustic feedback can be increased because the substantial components of the click mechanism are realized in the contactor and thus in a single component.

Figure 13:
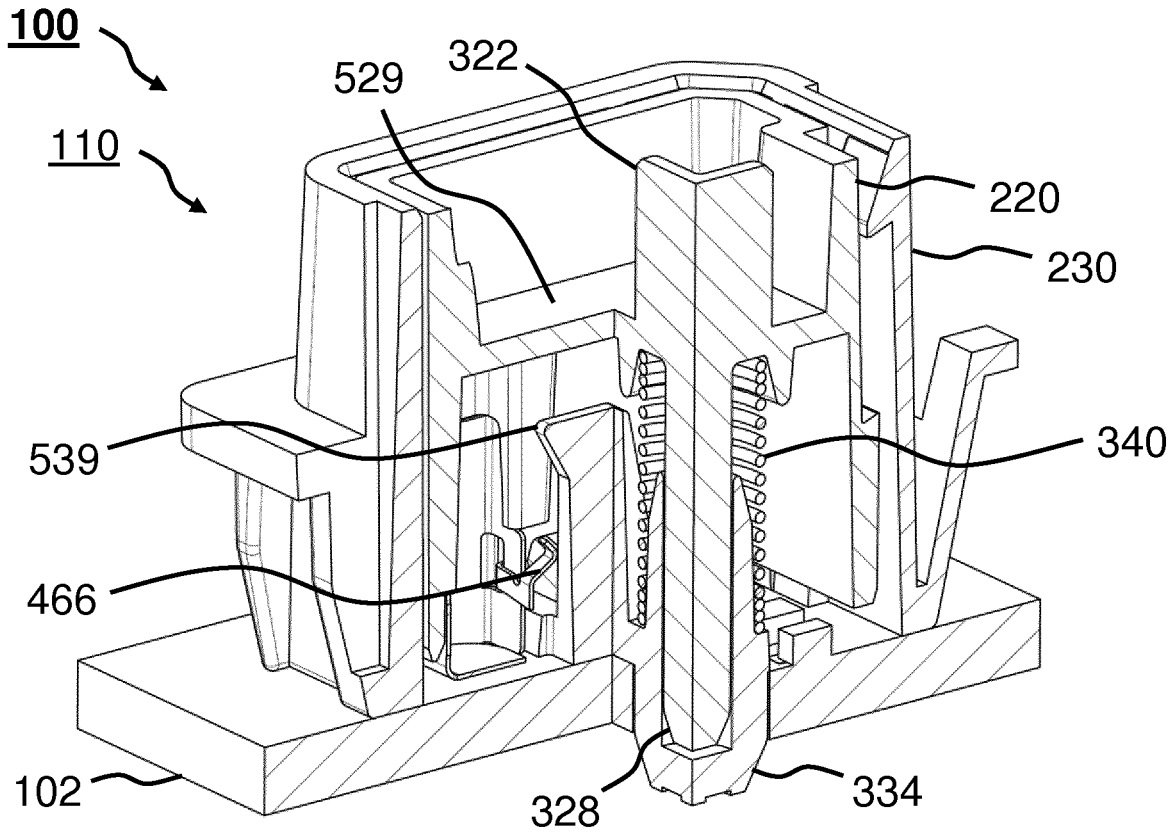
FIG. 13 shows a partially sectional view of a subsection of a keyboard according to an embodiment of the present invention with a key module in an actuated position.

FIG. 13 shows a partially sectional view of a subsection of a keyboard 100 according to an embodiment of the present invention with a key module 110 in an actuated position. The illustration in FIG. 13 corresponds to the illustration from FIG. 12, except that the key module 110 is shown in a further course of the actuation movement in the actuated position or at a reversal point of the actuation movement.

Figure 14:
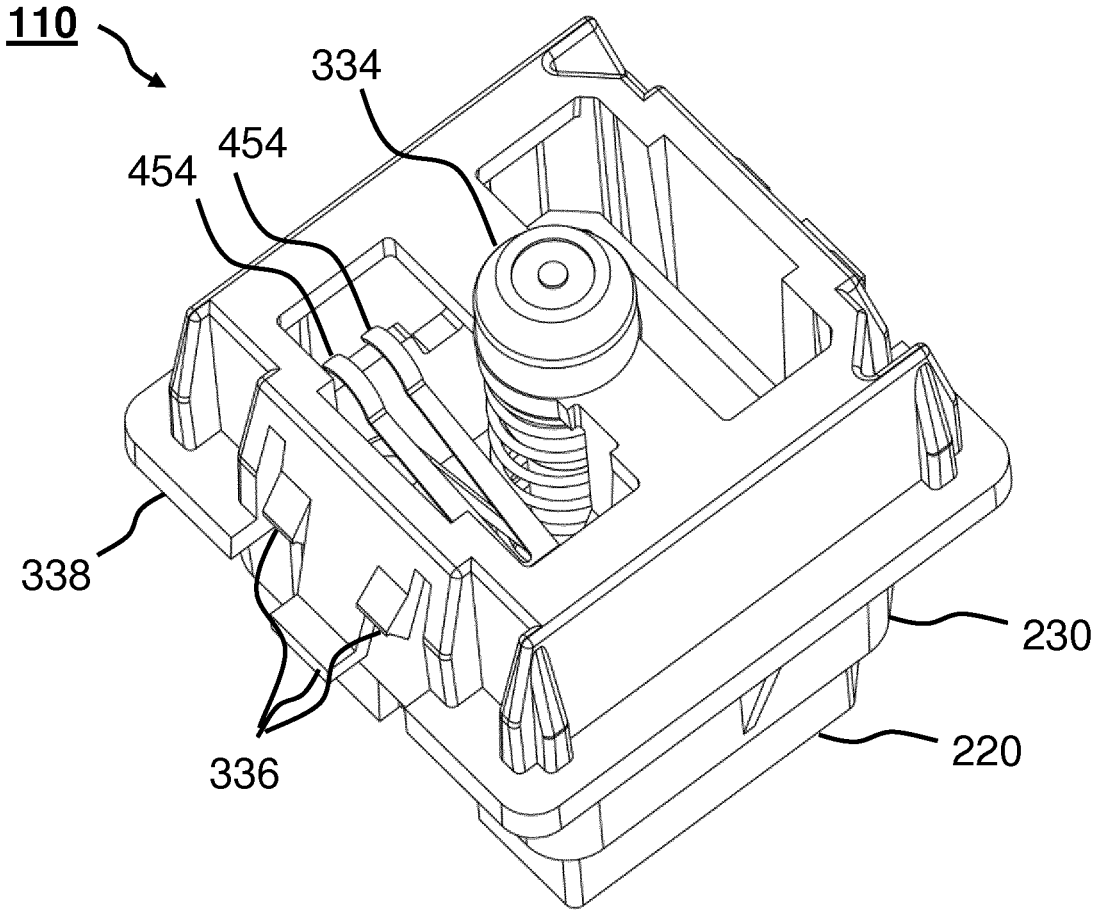
FIG. 14 shows a bottom view of a key module according to an embodiment of the present invention.

FIG. 14 shows a bottom view of a key module 110 according to an embodiment of the present invention. A subsection of the key tappet 220, the module housing 230 with the positioning protrusion 334, the mounting portion 336 and the flange 338, as well as the contact fingers 454 of the contactor are shown of the key module 110. Two cutouts are formed in a bottom portion of the module housing 230 directable toward the circuit substrate. Through one of the cutouts, the contact fingers 454 of the contactor come into contact with the circuit substrate for shorting the contact pads. Through the other one of the cutouts, the key module 110 can be eliminated by means of a light-emitting diode on the circuit substrate, particularly from the inside or via an inside of the key module 110.

Figure 15:
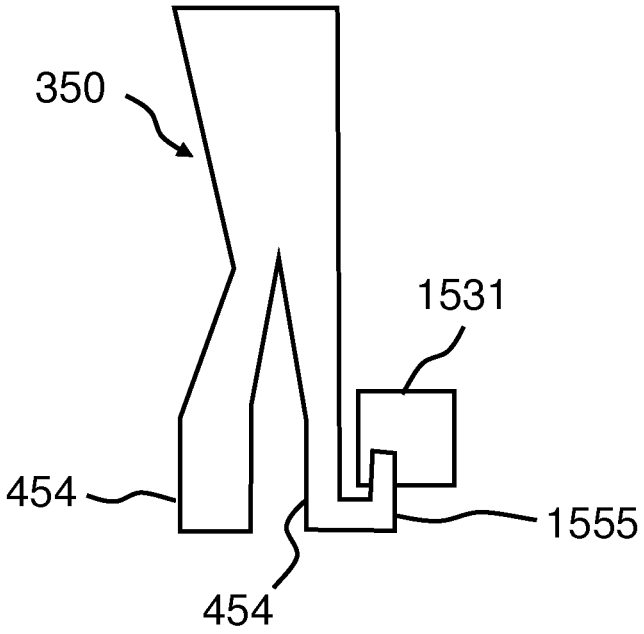
FIG. 15 shows a schematic bottom view of a subsection of a key module according to an embodiment of the present invention.

FIG. 15 shows a schematic bottom view of a subsection of the key module according to an embodiment of the present invention. In the illustration of FIG. 15, the trigger element 350 with for example only two contact fingers 454 and an abutment surface 1531 of the module housing are shown of the key module. The key module in FIG. 15 corresponds to the key module from one of the previously described figures, except that the module housing comprises the abutment surface 1531. The abutment surface 1531 is formed and arranged so that the trigger element 350 is arranged so as to abut on the abutment surface 1531 in the rest position of the key tappet of the key module.

According to the embodiment illustrated here, one of the contact fingers 454 is arranged so as to abut on the abutment surface 1531 in the rest position of the key tappet of the key module. To this end, the trigger element 350 has a rest portion 1555 on the contact fingers 454 in question. In the rest position there is mechanical contact between the rest portion 1555 and the abutment surface 1531. In other words, the rest portion 1555 abuts on the abutment surface 1531 in the rest position.

By the trigger element 350 or the contactor abutting on the abutment surface 1531 as a stop in the rest position, undesired vibrations of the trigger element 350, in particular also of the contact fingers 454, can be dampened or prevented.

Figure 16:
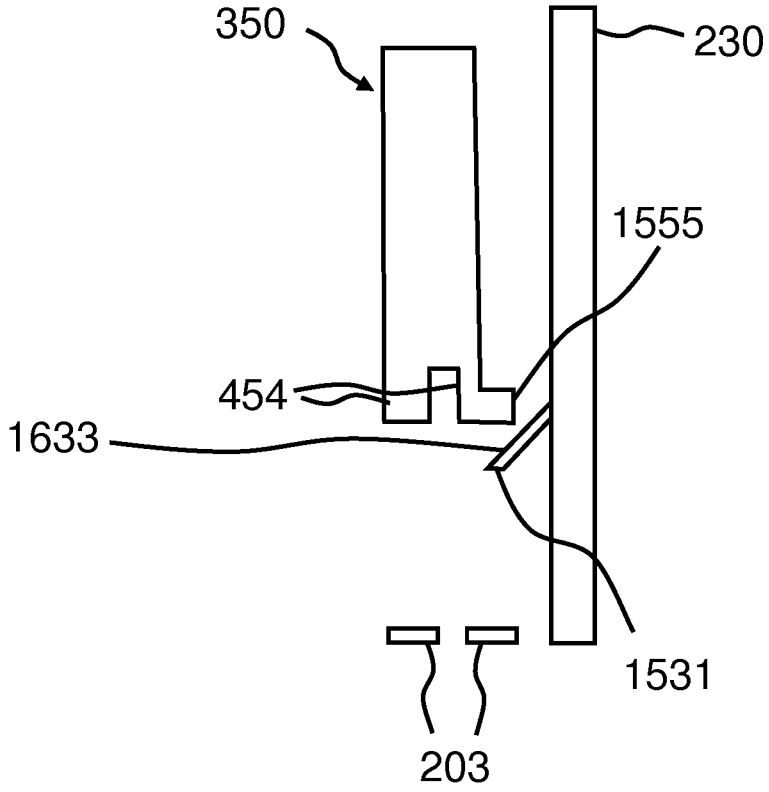
FIG. 16 shows a partially sectional view of a subsection of a keyboard according to an embodiment of the present invention with a key module prior to assembly or first-time actuation.

FIG. 16 shows a partially sectional view of a subsection of a keyboard according to an embodiment of the present invention with a key module prior to assembly or first-time actuation. The keyboard is the keyboard from one of the previously described figures. The key module corresponds to or resembles the key module from FIG. 15, wherein in FIG. 16 a sidewall of the module housing 230 with a damper portion comprising the abutment surface 1531 and an inclined surface 1633 and the trigger element 350 with the for example only two contact fingers 454 and the rest portion 1555 are shown of the key module and the contact pads 203 of the circuit substrate are shown of the keyboard.

In FIG. 16, what is shown is a state prior to assembly or first-time actuation of the key module of the keyboard. Prior to the assembly or first-time actuation, the damper portion with the abutment surface 1531 and the inclined surface 1633 is arranged between the trigger element 350 and the contact pads 203. The inclined surface 1633 is formed to enable or cause first-time and non-recurring sliding of the trigger element 350. The abutment surface 1531 may be oriented at an acute angle or parallel to the inclined surface 1633. The abutment surface 1531 at least is formed such that sliding back to the position prior to the assembly or first-time actuation is prevented.

During assembly or first-time actuation of the key module, the trigger element 350 can be deflected along the inclined surface 1633 and guided past the damper portion for the first and only time and thus slide past the damper portion. Additionally or alternatively, when the trigger element 350 is sliding across the inclined surface 1633, the damper portion, particularly the inclined surface 1633, can be deflected. Thus, in addition to or as an alternative to the trigger element 350, also the damper portion may comprise flexible material.

Figure 17:
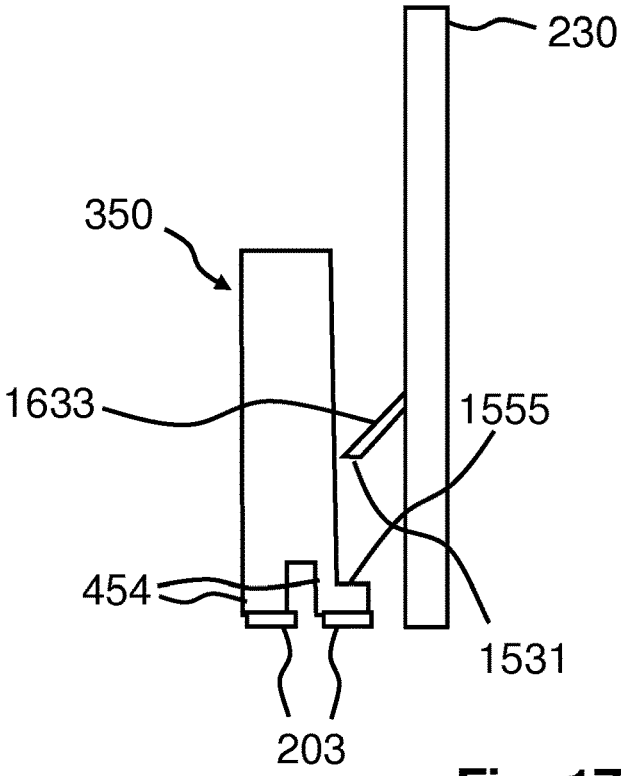
FIG. 17 shows a partially sectional view of the subsection of the keyboard from FIG. 16 with the key module in an actuated position.

FIG. 17 shows a partially sectional view of the subsection of the keyboard from FIG. 16 with the key module in an actuated position. Here, the illustration in FIG. 17 corresponds to the illustration from FIG. 16 except for the key module being shown in the actuated position, wherein electric contact is established between contact fingers 454 and the contact pads 203. Here, the contact fingers 454 and the rest portion 1555 are arranged between the contact pads 203 and the damper portion with the abutment surface 1531 and the inclined surface 1633 formed on the module housing 230. Also, the rest portion 1555 is spaced from the damper portion, in particular the abutment surface 1531, here. Starting from the state illustrated in FIG. 16 and moving to the state shown in FIG. 17, the rest portion 1555 of the trigger element 350 has slid past on the inclined surface 1633 and the abutment surface 1531 for the first and only time.

Figure 18:
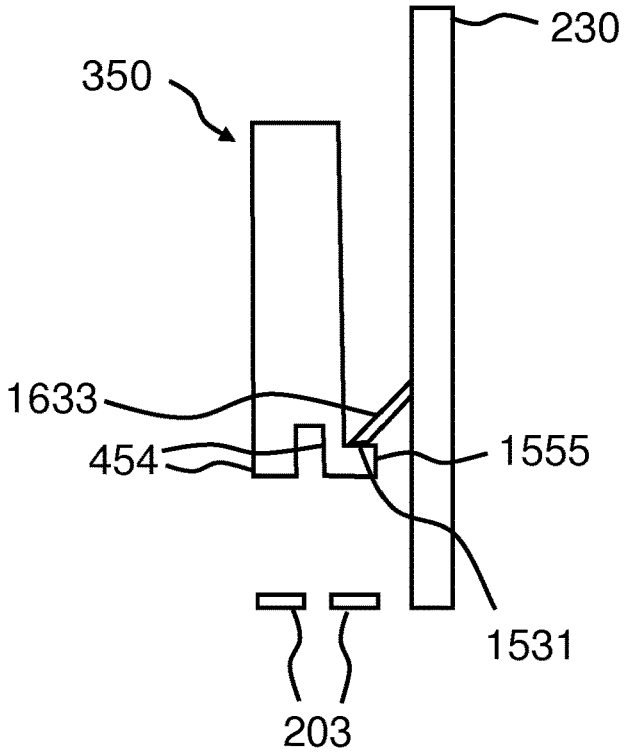
FIG. 18 shows a partially sectional view of the subsection of the keyboard from FIG. 16 or FIG. 17 with the key module in a rest position.

FIG. 18 shows a partially sectional view of the subsection of the keyboard from FIG. 16 or FIG. 17 with the key module in a rest position. Here, the illustration in FIG. 18 corresponds to the illustration from FIG. 17, except that the key module is shown in the rest position, wherein the rest portion 1555 of the trigger element 350 abuts on the abutment surface 1531. Noise due to vibrations of the trigger element 350, in particular the contact fingers 454, can thus be prevented. The trigger element 350, more specifically the rest portion 1555, cannot slide back across the damper portion again to reach the state shown in FIG. 16, for example. The rest portion 1555 engages behind the abutment surface 1531, for example.

According to an embodiment and with reference to the previously described figures, in an assembly method for assembling the key module 110, the key tappet 220 with the trigger element 350 arranged thereon can be inserted into the module housing 230. Here, a relative movement of the key tappet 220 with the trigger element 350 with respect to the module housing 230 can be effected along the axis A of the actuation movement. The trigger element 350 and/or the damper portion or the inclined surface 1633 also is deflected during this relative movement so that the trigger element 350 is guided past the damper portion and slides past the damper portion for the first and only time. The relative movement takes place when inserting the key tappet 220 including the trigger element 350 to the module housing 230 at least until the rest position is reached. By the trigger element 350 abutting on the abutment surface 1531, return of the key tappet 220 or the trigger element 350 to a position like prior to assembly, see FIG. 16, is prevented.

If an embodiment comprises an "and/or" connection between a first feature and a second feature, this may be read to mean that the embodiment comprises both the first feature and the second feature according to one embodiment and either only the first feature or only the second feature according to a further embodiment.

REFERENCE NUMERALS

100 keyboard
102 circuit substrate
104 fixing element
106 keycap
110 key module
201 hole
203 contact pads
205 electronic devices
207 holding opening
220 key tappet
230 module housing
322 coupling portion
324 tappet stop
326 surface portion
328 guiding stud
332 housing stop
334 positioning protrusion
336 mounting portion
338 flange
340 elastic means
350 trigger element
452 attachment portion
454 contact finger
456 opening
458 deflection portion
462 first leg
464 second leg
466 control cam
468 strike portion
529 intermediate bottom
539 actuation cam
1531 abutment surface
1555 rest portion
1633 inclined surface

The invention claimed is:

1. A key module for a keyboard, wherein the key module comprises:

a key tappet, wherein the key tappet comprises a coupling portion for coupling with a keycap for the key module, wherein the key tappet comprises at least one guiding portion for guiding a translational actuation movement of the key tappet between a rest position and an actuated position, wherein the key tappet comprises at least one tappet stop for limiting the actuation movement;

a trigger element for triggering a switch signal of the key module in response to the actuation movement, wherein the trigger element is attachable to the key tappet, wherein the trigger element is formed as a contactor for electrically shorting contact pads of the circuit substrate of the keyboard, wherein the contactor comprises an attachment portion, by means of which the contactor is attachable to the key tappet of the key module, and wherein the contactor is integrally formed;

a module housing, wherein the module housing is integrally formed, wherein the module housing comprises at least one positioning protrusion for positioning the key module on a circuit substrate of the keyboard, wherein the module housing is formed to movably accommodate the key tappet, in order to enable the actuation movement of the key tappet relative to the module housing, wherein the module housing comprises at least one housing stop for abutment against the at least one tappet stop of the key tappet in the rest position of the key tappet; and elastic means, with the elastic means being configured to bias the key tappet into the rest position in an assembled state of the key module.

2. The key according to claim 1, wherein the module housing comprises at least one mounting portion for positive and/or non-positive locking of the key module in the keyboard.

3. The key module according to claim 1, wherein the at least one guiding portion of the key tappet comprises a surface portion of the key tappet and/or a guiding stud formed to plunge into a bulge of the module housing in the course of the actuation movement, wherein the bulge comprises the positioning protrusion.

4. The key module according to claim 1, wherein the key tappet comprises a surface portion formed as a multi-sided pipe, wherein an intermediate bottom is formed in a region enclosed by the surface portion, wherein the coupling portion extends from the intermediate bottom in a first direction partially out of the surface portion, wherein a guiding stud as guiding portion extends from the intermediate bottom in a second direction opposite to the first direction partially out of the surface portion.

5. The key module according to claim 1, wherein the key tappet is formed of a translucent material or an opaque material, wherein the module housing is formed of a translucent material or an opaque material.

6. The key module according to claim 1, wherein the trigger element comprises at least one contact finger, which is elastically deformable in the course of the actuation movement, for contacting the contact pads while generating friction and an attachment portion for attaching the trigger element to the key tappet.

7. The key module according to claim 6, wherein the trigger element comprises a deflection portion, which is elastically deflectable in the course of the actuation movement, for effecting acoustic feedback and/or tactile feedback, wherein the module housing comprises an actuation cam formed to deflect the deflection portion of the trigger element in the course of the actuation movement.

8. The key module according to claim 7, wherein the deflection portion is arranged between the contact finger and the attachment portion of the trigger element, wherein the deflection portion is formed to be U-shaped with a first leg and a second leg, wherein the first leg is rigidly connected to the trigger element, wherein the second leg is formed as a clapper movable relative to the first leg with a control cam for interaction with the actuation cam of the module housing.

9. The key module according to claim 8, wherein the trigger element comprises an opening, wherein the second leg engages with the opening, wherein the opening is formed to enable a first movement of the second leg towards the first leg and away from the first leg for the tactile feedback and optionally additionally a second movement of the second leg transversal to the first movement for the acoustic feedback.

10. The key module according to claim 1, wherein the module housing comprises an abutment surface, wherein the trigger element is arranged so as to abut on the abutment surface in the rest position of the key tappet.

11. The keyboard, wherein the keyboard comprises:

at least one key module according to claim 1; and the circuit substrate, wherein the at least one key module is arranged on the circuit substrate.

12. The keyboard according to claim 11, wherein the circuit substrate comprises at least one hole into which the at least one positioning protrusion of the module housing of the at least one key module is inserted.

13. The keyboard according to claim 11, wherein the at least one key module and the circuit substrate are connected to each other exclusively with positive locking and/or with non-positive locking.

14. The keyboard according to claim 11, wherein at least one light-emitting diode for eliminating the at least one key module and/or further electronic devices and/or contact pads electrically connectable to each other upon actuation of the at least one key module are arranged on or in the circuit substrate.

15. The keyboard according to claim 11, with a fixing element for fixing the at least one key module to the circuit substrate, wherein the fixing element is formed as a key frame between the circuit substrate and a keyboard top or as a keyboard top.

* * * * *